United States Patent [19]

Phan Van Cang

[11] Patent Number: 4,692,759

[45] Date of Patent: Sep. 8, 1987

[54] APPARATUS FOR MODIFYING THE APPEARANCE OF THE POINTS OF AN IMAGE ON THE SCREEN OF A GRAPHIC IMAGE DISPLAY CONSOLE

[75] Inventor: Luc Phan Van Cang, Savigny sur Orge, France

[73] Assignee: Thomson Video Equipement, Gennevilliers, France

[21] Appl. No.: 723,359

[22] Filed: Apr. 15, 1985

[30] Foreign Application Priority Data

Apr. 17, 1984 [FR] France ..... 84 06052

[51] Int. Cl.[4] ..... G09G 1/16

[52] U.S. Cl. ..... 340/748; 340/750

[58] Field of Search ..... 340/703, 735, 748, 750, 340/747, 798, 799, 723

[56] References Cited

U.S. PATENT DOCUMENTS

| | | | |
|---|---|---|---|
| 4,303,986 | 12/1981 | Hakan Lans . | |
| 4,414,545 | 11/1983 | Sakurada et al. | 340/735 |
| 4,420,770 | 12/1983 | Rahman | 340/703 |
| 4,462,028 | 7/1984 | Ryan et al. | 340/799 |
| 4,504,828 | 3/1985 | Couper et al. | 340/748 |

OTHER PUBLICATIONS

Wescon Conference Record, vol. 25, Sep. 1981, pp. 31/5 (1-10), El Segundo, CA, US; J. L. Wise et al.; "Color Graphics with an Advanced LSI Controller"; p. 2.

*Primary Examiner*—Gerald L. Brigance

*Attorney, Agent, or Firm*—Oblon, Fisher, Spivak, McClelland & Maier

[57] ABSTRACT

An apparatus for modifying the appearance of the points of an image on the screen of a graphic image display console comprising a graphic memory storing all the points of the screen interposed between the screen and the display console and a control processor. The graphic memory is organized in words of n bits, each bit is representative of the state of a point of the image and has a value 1 or 0 depending on whether the point which it represents in the image is visible or merges with the background of the image. An attribute memory contains the attributes of each of the image points. The device also comprises a decoder for selecting a bit from each word read out from the graphic memory. A modification circuit is connected to the decoder, to the attribute memory and to the processor for modifying each attribute of the point corresponding to the bit selected of a word by means of modification bits supplied by the processor and for storing each modified attribute in the attribute memory. A reformation circuit is coupled to the modification circuit, to the decoder and to the graphic memory for reconstructing the modified word and for storing it in the graphic memory.

7 Claims, 3 Drawing Figures

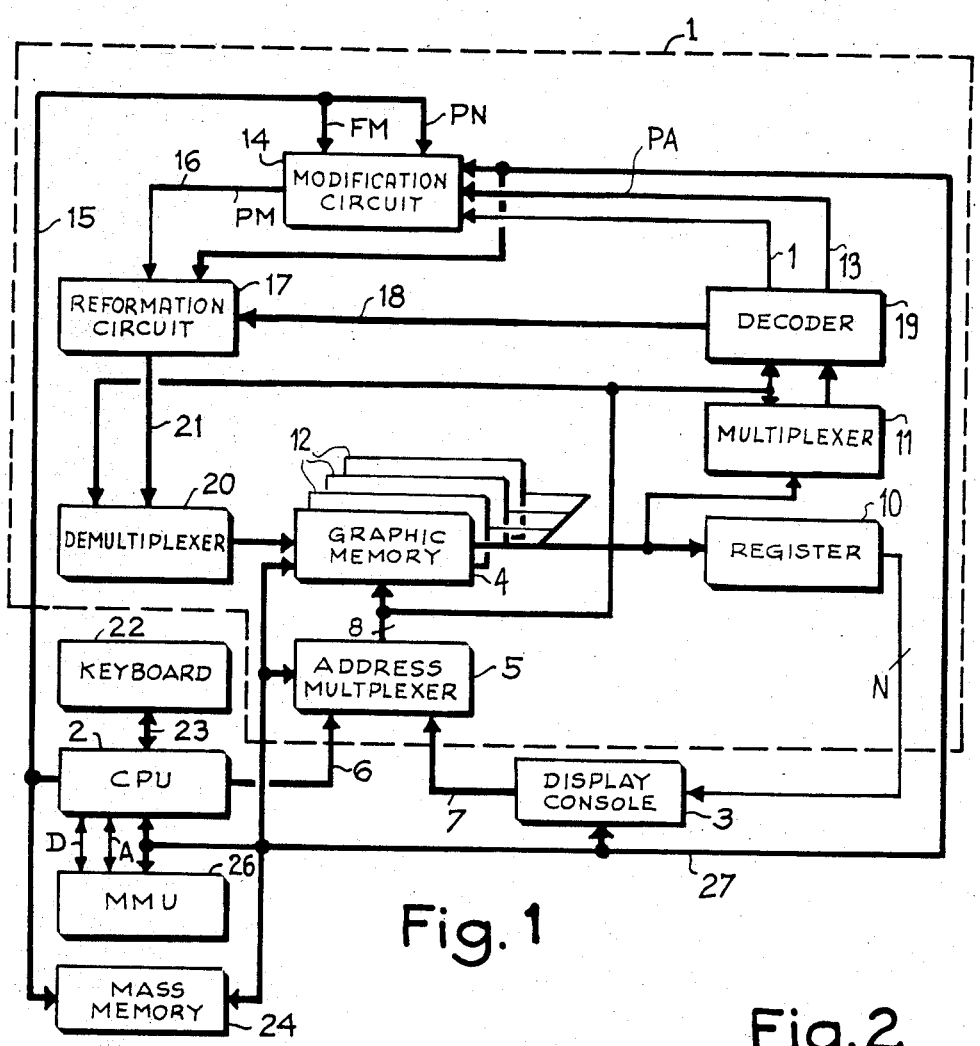
Fig. 1
Fig. 2
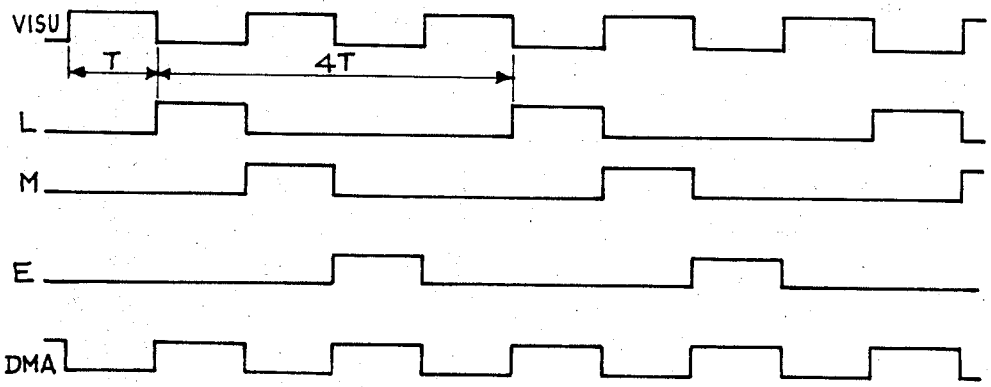

APPARATUS FOR MODIFYING THE APPEARANCE OF THE POINTS OF AN IMAGE ON THE SCREEN OF A GRAPHIC IMAGE DISPLAY CONSOLE

The present invention relates to an apparatus for modifying the appearance of the points of an image on the screen of a graphic image display console, the image being analyzed according to the same principle of analysis as television images, and the console being controlled by a graphic processor.

BACKGROUND OF THE INVENTION

Display consoles controlled by a graphic processor comprise a random access graphic memory interposed between the screen of the console and the processor which stores the data relative to each point or "pixel" of the graphic diagram appearing on the screen. The modification of the graphic diagram may be obtained any time by changing the contents of the data relative to each point of the diagram memorized in the graphic memory, which results in modifying the luminance and/or the color of each point or pixel of the graphic diagram which is to be modified. The modification is usually carried out by an operator who, using a keyboard connected to the processor, feeds in the instructions for modifying the data relative to each of the modified points. The action of the operator on the keyboard initiates in the processor a modification cycle which is executed either by initiating a particular program or by bringing into action wired logic operators.

Although the programming methods used allow a very high and complex number of replacement operations to be effected at low cost, they have as disadvantage the fact of occupying much of the computing cycle time of the processor. On the other hand, use of wired logics provides a saving in processing time but has the disadvantage of being expensive and to be limited to the use of elementary logic operators which very substantially reduces the possibilities of wired logic systems.

SUMMARY OF THE INVENTION

The aim of the invention is to overcome the above mentioned disadvantages.

For this, the invention provides a device for modifying the appearance of an image on the screen of a console for displaying graphic images analyzed in accordance with the principle for analyzing television images, controlled by a graphic processor of the type comprising a graphic memory for storing all the points of the screen, interposed between the screen of a display console and the processor, the graphic memory being organized in words of n bits, each bit being representative of the state of a point of the image and having a value 1 or 0 depending on whether the point which it represents on the image is visible or merges with the background of the image and an attribute memory containing the attributes of each of the points of the image, which device further comprises a decoder for selecting a bit from each word read out from the graphic memory and a modification circuit connected to the decoder, to the attribute memory and to the processor for modifying each attribute of the point corresponding to the bit selected by means of the modification bits supplied by the processor and memorizing each attribute modified in the attribute memory, and a reformation circuit coupled to the modification circuit, to the decoder and to the graphic memory for reconstructing the modified word and storing it in the graphic memory.

The main advantage of the device of the invention is that it allows optimization of the reading, modification and writing cycle time of each point or pixel whose corresponding data is stored in the graphic memory as well as the range of operations which may be carried out within this cycle. By offering the possibility of processing in parallel each word contained in the graphic memory with each of the corresponding attributes of the points or pixels, the device of the invention has great processing flexbility, practically identical to that obtained with purely software processing systems while providing faster processing.

BRIEF DESCRIPTION OF THE DRAWINGS

Other features and advantages of the invention will be clear from the following description with reference to the accompanying drawings given solely by way of example and in which:

FIG. 1 is a representation of the device of the invention;

FIG. 2 shows the timing diagrams for the refreshing cycle of the screen of a display console scanned according to the scanning principle of television screens of the reading, modification and writing cycle of the graphic memory as well as of the direct DMA cycle for accessing the graphic memory;

DESCRIPTION OF THE PREFERRED EMBODIMENT

Figure 3:
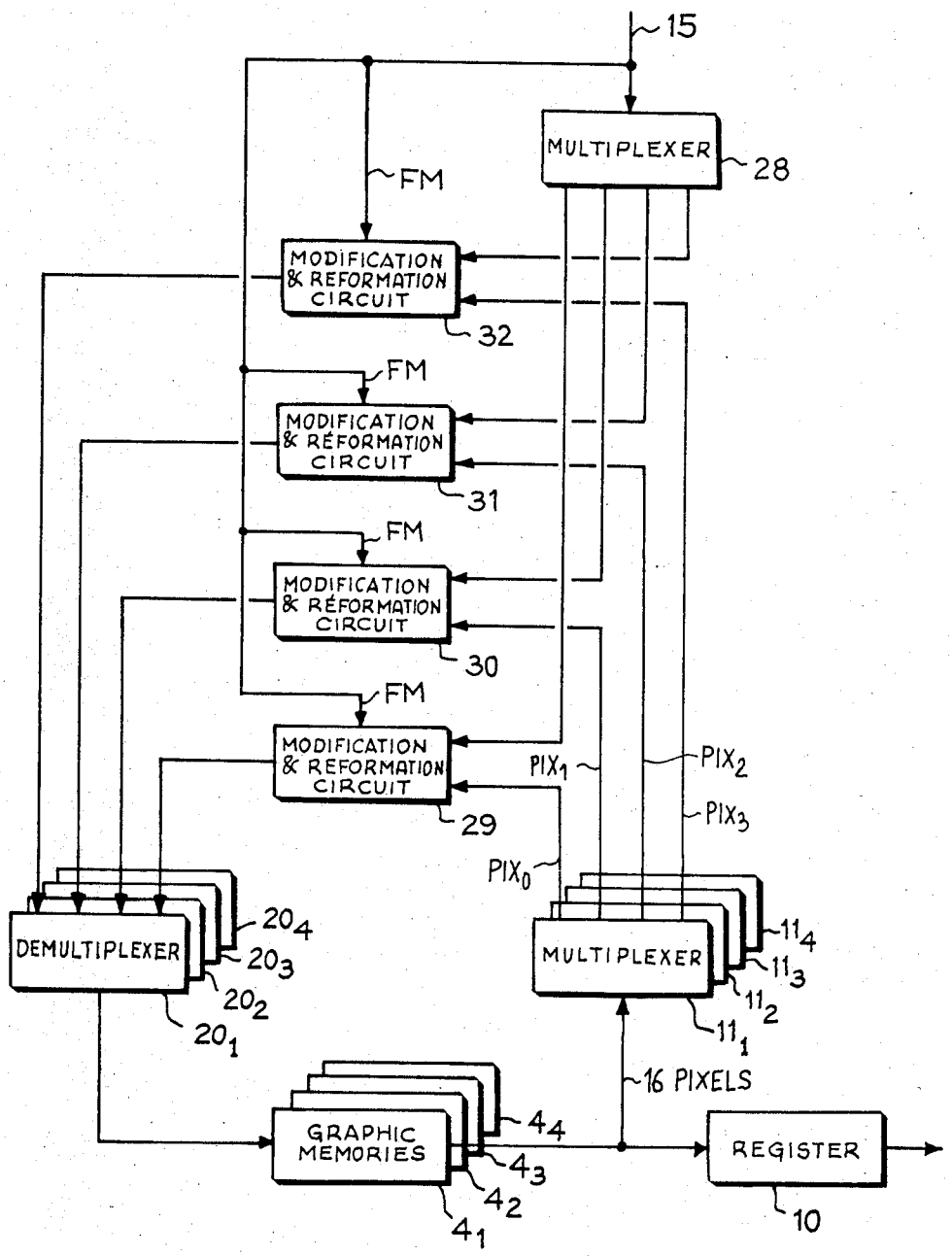
FIG. 3 shows a parallel organization of the device shown in FIG. 1 for modifying in parallel the whole of the data relative to the points or pixels of the image of a graphic diagram contained in a word of the graphic memory.

Device 1 for modifying the appearance of the points of an image written on a screen of a display console in accordance with the invention is shown in FIG. 1 inside a broken line, coupled between a processor 2 or CPU and a display control 3. Device 1 comprises a graphic memory 4 which contains a binary matrix representation of all the characteristic points of the graphic image which is displayed on the display console 3, each information bit contained in the graphic memory 4 having for example the value 0 when it corresponds to the uniform background of the diagram and the bit value 1 when it corresponds to a point or pixel of the diagram which stands out from the background thereof. The graphic memory is organized in words of n bits representing the state of n pixels, each word being addressed either by the processor 2 or by the display console 3 through an address multiplexer circuit 5 with the two multiplexing inputs, one multiplexing input being connected by the address line 6 to the address output of processor 2 and a second address input being connected by address line 7 to the address output of the display console 3. The output of address multiplexer 5 is connected to the addressing inputs of the graphic memory 4 through the address line 8. The data read out from graphic memory 4 at the memory positions designated by the address words applied to the address line 8 are applied respectively to the inputs of a parallel-series register 10 and to the inputs of a multiplexer circuit 11. Device 1 also comprises an attribute memory 12 formed possibly by p additional memory planes of the graphic memory 4 which contains the attributes coded over p bits respective to each of the n pixels represented in each word of n bits contained in the graphic memory 4, this attribute memory 12 beind addressed simultaneously with graphic memory 4 over the address line 8. The words read out from the graphic memory and from the attribute memory 12 are applied to the circuits not shown of the display console 3 through the register 10 so as to allow the display of the pixels which they represent by the display console. The attribute words PA of each pixel, addressed by each of the address words applied over the address line 8, are applied by a data line 13 to a first input of a modification circuit 14 through the multiplexer 11 and a decoder 19 connected in series. The modification circuit 14 is connected by second and third inputs to the data outputs of the processor 2 by means of a data line 15 for applying modification data designated FM and PN to the second and third inputs of the modification circuit 14 for modifying the values of the attributes of the points or pixels PA read out from the attribute memory 12 and which are applied to the first input of the modification circuit 14 over the data line 13. The output of the modification circuit 14 is connected by a data line 16 to a data input of a reformation circuit 17 for recording each attribute PM modified by the modification circuit 14 at the position which it occupies in the attribute memory 12. The reformation circuit 17 is also connected by a second input through line 18 to the output of the decoder 19 addressed by the address line 8 and connected by its input to the output of multiplexer 11. The purpose of the decoder 19 addressed by the address line 8 is to select, within the n bit word applied to the input of multiplexer 11, each bit designated by the address word applied to its input and the attribute word PA coded over p bits which corresponds to it. The bit representative of the selected pixel and its attribute PA are applied respectively to a fourth input and to the first input of the modification circuit 14 for possibly modifying their values as a function of the modification data which is applied to the second and third inputs of the modification circuit 14. The bits not selected by decoder 19 are applied by line 18 to the input of the reformation circuit 17 which reforms, depending on the information modified or not supplied at the output of the modification circuit 14, a new binary word which is applied to the input of a writing demultiplexer circuit 20 by means of a data bus 21 for writing the word possibly modified and the corresponding attributes and the address which they normally occupy in the graphic memory 4 and the attribute memory 12. The modification data of each of the words contained in the graphic memory 4 and the attribute memory 12 are fed in from a keyboard 22 which is connected to processor 2 through the connecting line 23. A mass memory 24 is possibly coupled by a line 25 to processor 18 for transferring into processor 2 the programming structure required for operating the whole. The processor 2 is also connected to a random access memory MMU 26 for storing during operation the instructions and data fed in from keyboard 22 or from the mass memory 24.

The graphic memory of the invention is a double access memory by cycle sharing. A first cycle is reserved for the operation of the display console 3, a second cycle is reserved for operation of the modification procedure controlled by processor 2, this modification cycle being characterized by a cycle for reading, a cycle for modifying and a cycle for rewriting the modified information in the graphic memory and a third direct reading cycle of the graphic memory, the whole of these cycles being shown by the timing diagram in FIG. 2. The cycles shown in FIG. 2 are executed by the processor 2 which applies control signals to the control bus 27 for refreshing the points or pixels of the graphic diagram displayed on the screen of the display control and for controlling the reading and writing cycles of the graphic memory 4 and of the attribute memory 12. In FIG. 2, the refreshing cycle marked "VISU" of the display console is shown with a duration T with a period of 2T, the cycle L for reading the information contained in the attribute memory 4 and in the attribute memory 12 is shown interlaced for a duration T outside the refreshing time for the display console 3 and with a period lasting 4T, the modification cycle M follows the reading cycle L with the same duration T and with the same period of equal duration 4T, the writing cycle E follows the modification cycle M with the same duration T and with the same period equal to 4T and the direct access cycle to the graphic memory and to the attribute memory takes place during a time T between the refreshing times of the display console 3. By way of example, this cycle sharing mode may be advantageously used for displaying words of 16 pixels for a time of 1184 nanoseconds and for executing reading-modification-writing cycles of twice 1184 nanoseconds per pixel or point to be modified, which allows high operating ranges to be covered, for example processing 720 image points or pixels per scanning line over 576 lines while complying with the CCI standard of 625 line television scanning, the output of the display console in this case corresponding to the digital television standard of 13.5 MHz for 25 images/second and the cycle time T being close to 400 nanoseconds. These results are obtained by organizing the graphic memory for example in words of 16 pixels and the attribute memory 12 in attribute words of 3 bits, each of the words being addressed by the processor 2 by the address bits applied to the address bus 8. Each word read out from the graphic memory 4 and from the attribute memory 12 is applied to the input of the multiplexer 11. The place of a bit in the word corresponding to the point or pixel to be modified is selected by the multiplexer 11 and decoder 19 from the four lowest weight bits of the address word at the same time as the three corresponding attribute bits are addressed in the attribute memory 12 by the address bus 8. The bits of the word not designated by the multiplexer 11 and decoder 19 are directed directly to the inputs of the word reformation device 17 whereas the selected bit is taken into account by the modification circuit 14. The three attribute bits read out from the attribute memory 12 corresponding to the point or to the pixel to be modified are applied to the first input of the modification circuit 14 while the processor 2 simultaneously applies over the data line 15, 4 modification bits PN at the same time as 6 function bits corresponding to the modification function FM chosen by the operator thus allowing 64 modification functions to be executed. The bit of the memory word selected and the corresponding attribute are modified so as to form a four bit word PM which is obtained at the output of the modification circuit 14 which is a functon of the value 0 or 1 of the bit of the point or pixel to be modified read out from the graphic memory 4, the corresponding attribute read out from the attribute memory 12, the modification data PN supplied by processor 2 to the input of the modification circuit 14 and the modification function also transmitted to the third input of the modification circuit 14 by the processor 2. This transformation is effected by means of electrically programmable read only memories of the EPROM type or by means of random access memories RAM containing tables of functions for modifying the appearance of the points of the graphic image addressed by the processor 2 and by the attribute bits PA of each word selected from the attribute memory, for fulfilling the multiple functions which may be given to the modification circuit, these functions being possibly simple logic functions of the logic AND, logic OR, EXCLUSIVE OR type or more complicated functions for executing for example linear interpolations between old pixels and new pixels, conditional operations, linear interpolation operations for the luminance attribute of a pixel as a function of the fractional addressing of the new pixel for resolving in particular the known aliasing phenomena of graphic processes, or else for executing super-imposition image texture controls, etc.

The invention which has just been described with reference to the embodiment shown in FIG. 1 is not limited to this type of emodiment, it is obvious that other embodiments are also possible without departing from the scope or spirit of the invention, in particular it will be readily understood that the invention also applies as in the example shown in FIG. 3, to the construction of more complex devices associating in parallel the device shown in FIG. 1 for versions of the invention requiring rapid processing. The device shown in FIG. 3 is formed from four devices of the type shown in FIG. 1 comprising in particular respectively graphic memories $\mathbf{4}_1$, $\mathbf{4}_2$, $\mathbf{4}_3$, and $\mathbf{4}_4$ and four modification and reformation circuits 29, 30, 31, 32 similar to the example shown in FIG. 1 and which allow processing of the consecutive pixels $PIX_0$, $PIX_1$, $PIX_2$, $PIX_3$ of the word of 16 pixels addressed in memories 4, . . . $\mathbf{4}_4$. The data bus 15 acts on the modification and reformation circuits 29, 30, 31, 32 through a multiplexer 28 which directs to each of the inputs of the circuits placed inside the circuits 29, 30, 31, 32 the modification data PN and the modification function FN. In the conditional transfer mode, this organisation for example allows all the pixels of the graphic memory to be modified concurrently with the same modification function FM applied to each of the modification and reformation circuits 29, 30, 31, 32 whereas in the graphic mode, for example, in the vector plotting mode, a single modification function FM corresponding to the only pixel addressed is activated. The conditional transverse speed is thus very substantially increased, in practice, with a parallel configuration, it is possible to process for example 8 pixels in parallel and to obtain an access time equivalent to 1200 ns/8, i.e.: 150 nanoseconds per pixel, or a conditional transfer time of the order of 80 milliseconds for an image of 512×512 pixels.

What is claimed is:

1. An apparatus for modifying the appearance of the points of an image on a screen of a graphic image television display, controlled by a graphic processor, said apparatus comprising:

a graphic memory storing all the points of the screen interposed between the screen of the display console and the processor, said graphic memory being organized in words of n bits, each bit being representative of the state of a point of the image and having a value of 1 or 0 depending on whether the point which it represents in the image is visible or merges with the background of the image, an attribute memory containing the attributes of each of the points of the image, a decoder for selecting a bit from each word read out from the graphic memory, a modification circuit memory connected to the decoder, to the attribute memory and to the graphic processor for modifying the value of each attribute of the point corresponding to the bit selected of a word by means of modification bits supplied by the processor and a reformation circuit register coupled to the modification circuit, to the decoder and to the graphic memory for updating each modified word and storing it in the graphic memory and storing each modified attribute in the attribute memory, said modification circuit being formed by programmable memories containing function tables for calculating new attribute for modifying the appearance of the points of the graphic image, said function tables being addressed by function bits and modification bits generated by the graphic processor and the attribute bits of each bit of a word selected from the graphic memory.

2. The apparatus as claimed in claim 1, wherein said modification and addressing bits of the modification functions are generated by the graphic processor from instructions fed into the processor from a keyboard.

3. The apparatus as claimed in claim 1, wherein said graphic memory is addressed either by the display console or by the graphic processor through an address multiplexer controlled by the processor for sharing the access cycles to the graphic memory initiated by the display console and the processor.

4. The apparatus as claimed in claim 3, wherein said graphic memory is organized in words of fixed length.

5. The apparatus as claimed in claim 4, wherein the access cycle of the processor to the graphic memory comprises a first cycle for reading each word in which is situated the the bit of an image point to be modified and the corresponding attribute bits in the attribute memory, a second cycle for modifying the bit of the corresponding point to be modified identified inside the word read out from the graphic memory and for modifying the attribute word read out from the attribute memory during the first cycle, and a third cycle for rewriting the word containing the modified bit in the graphic memory and for rewriting the modified attribute word in the attribute memory.

6. The apparatus as claimed in claim 5, wherein the programmable memories of the modification circuit are electrically programmable read only memories.

7. The apparatus as claimed in claim 5, wherein said programmable random access memories of the modification circuit are random access memories.

* * * * *